US008705779B2

(12) United States Patent
Lee et al.

(10) Patent No.: US 8,705,779 B2
(45) Date of Patent: Apr. 22, 2014

(54) SURROUND SOUND VIRTUALIZATION APPARATUS AND METHOD

(75) Inventors: Kang Eun Lee, Hwaseong-si (KR); Do-Hyung Kim, Hwaseong-si (KR); Chang Yong Son, Gunpo-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 457 days.

(21) Appl. No.: 12/458,028

(22) Filed: Jun. 29, 2009

(65) Prior Publication Data

US 2010/0166238 A1 Jul. 1, 2010

(30) Foreign Application Priority Data

Dec. 29, 2008 (KR) ..... 10-2008-0135351

(51) Int. Cl.
*H04R 5/033* (2006.01)

(52) U.S. Cl.
USPC ..... 381/309; 381/1; 381/310; 381/61; 381/63; 381/74; 381/303; 381/304; 381/305; 381/17; 381/18; 381/19; 381/20; 381/21; 381/22; 381/23; 700/94

(58) Field of Classification Search
USPC ..... 381/1, 309, 310, 61, 63, 74, 303–305, 381/17–23; 700/94
See application file for complete search history.

(56) References Cited

U.S. PATENT DOCUMENTS

| | | | | |
|---|---|---|---|---|
| 4,509,191 | A * | 4/1985 | Miller | 381/63 |
| 5,502,747 | A * | 3/1996 | McGrath | 375/350 |
| 5,742,689 | A * | 4/1998 | Tucker et al. | 381/17 |
| 6,307,941 | B1 * | 10/2001 | Tanner et al. | 381/17 |
| 7,006,636 | B2 | 2/2006 | Baumgarte et al. | |
| 7,382,885 | B1 * | 6/2008 | Kim et al. | 381/17 |
| 7,889,870 | B2 * | 2/2011 | Chun | 381/1 |
| 2003/0202665 | A1 * | 10/2003 | Lin et al. | 381/17 |
| 2005/0276430 | A1 * | 12/2005 | He et al. | 381/309 |
| 2006/0045294 | A1 * | 3/2006 | Smyth | 381/309 |
| 2006/0198527 | A1 * | 9/2006 | Chun | 381/17 |
| 2006/0198542 | A1 * | 9/2006 | Benjelloun Touimi et al. | 381/307 |
| 2007/0154019 | A1 * | 7/2007 | Kim | 381/17 |
| 2007/0160218 | A1 | 7/2007 | Jakka et al. | |
| 2007/0223749 | A1 * | 9/2007 | Kim et al. | 381/309 |
| 2008/0273721 | A1 * | 11/2008 | Walsh | 381/300 |
| 2009/0304214 | A1 * | 12/2009 | Xiang et al. | 381/307 |

FOREIGN PATENT DOCUMENTS

| | | |
|---|---|---|
| KR | 10-2007-0091517 | 9/2007 |
| KR | 10-2007-0091586 | 9/2007 |
| KR | 10-2008-0093419 | 10/2008 |

OTHER PUBLICATIONS

Jot et al, Binaural 3-D audio rendering based on spatial audio scene coding, Audio Engineering Society, Oct. 5-8, 2007.*
Adams et al; State-Space Synthesis of Virtual Auditory Space, IEEE, Jul. 2008.*
Mixed Signals ICs, An Audio Delay circuit based on the MX609 CVSD Codec, 1998.*

(Continued)

*Primary Examiner* — Davetta W Goins
*Assistant Examiner* — Kuassi Ganmavo
(74) *Attorney, Agent, or Firm* — Staas & Halsey LLP

(57) ABSTRACT

A surround sound virtualization apparatus and method. The surround sound virtualization apparatus may include an audio decoder to perform head-related transfer function (HRTF) filtering, and a time delay unit to provide a time delay to a plurality of output signals of the audio decoder.

17 Claims, 8 Drawing Sheets

(56) References Cited

OTHER PUBLICATIONS redcircuit.com, portable 9v headphone amplifier, Feb. 2008.*
Rod elliott, class a amplifiers a brief explanation,2005.*
Kangeun Lee et al., "Low Complexity Binaural Rendering for Multi-channel Sound", Audio Engineering Society Convention Paper, May 7-10, 2009, Germany, 7 pages.-3.

* cited by examiner

SURROUND SOUND VIRTUALIZATION APPARATUS AND METHOD

CROSS-REFERENCE TO RELATED APPLICATIONS

This application claims the benefit of Korean Patent Application No. 10-2008-0135351, filed on Dec. 29, 2008, in the Korean Intellectual Property Office, the disclosure of which is incorporated herein by reference.

BACKGROUND

1. Field

Example embodiments relate to a surround sound virtualization apparatus and method, and more particularly, to a surround sound virtualization apparatus and method which may reduce computational costs for surround sound virtualization, and thereby may improve a performance of surround sound virtualization.

2. Description of the Related Art

Currently, audio technologies are developed to achieve realistic sound rather than simply high-definition sound due to an increase in the number of using channels. Accordingly, much research on surround sound virtualization technologies has been actively conducted. In a surround sound virtualization system, stereo sound may be received from a sound source, and upmixing may be performed towards a front left channel, a front right channel, a center channel, a surround left channel, a surround right channel, and a subwoofer speaker to be extended to a plurality of channels such as 5.1 channels. Also, sound downmixing to 2-channel sound may be done again, and the downmixed sound may be delivered to front left and right speakers. In a virtual surround system using headphones, the frequency characteristic of an input signal is modified by filtering with a head-related transfer function (HRTF). Also, the way that actual sound reaches an audience's ears based on a phase difference may be imitated.

In this instance, a huge amount of computations are required for surround sound virtualization, and therefore surround sound virtualization may not be achieved due to impractical complexity.

Accordingly, a surround sound virtualization apparatus and method which may embody surround sound virtualization with a small computational cost is required.

SUMMARY

According to example embodiments, there may be provided a surround sound virtualization apparatus, including an audio decoder to perform head-related transfer function (HRTF) filtering, and a time delay unit to provide a time delay to a plurality of output signals of the audio decoder.

The audio decoder may include a spectral decoding unit to extract a plurality of channel signals from an encoded bit stream, a surround virtualization unit to perform the HRTF filtering with respect to the plurality of extracted channel signals, and a domain transform unit to transform output signals of the surround virtualization unit into a time domain.

The surround virtualization unit may perform the HRTF filtering in a frequency domain.

The surround virtualization unit may multiply the plurality of extracted channel signals with a plurality of response functions for applying an HRTF frequency characteristic.

The domain transform unit may include a signal addition unit to add all or a portion of the output signals of the surround virtualization unit into at least one added output signal, and an inverse transform unit to transform the at least one added output signal into the time domain.

According to example embodiments, there may be provided a surround sound virtualization method, including extracting a plurality of channel signals from an encoded bit stream, performing HRTF filtering with respect to the plurality of extracted channel signals, transforming the plurality of filtered signals into a time domain, and providing a time delay to the plurality of signals transformed into the time domain.

Additional aspects and/or advantages of the example embodiments will be set forth in part in the description which follows and, in part, will be apparent from the description, or may be learned by practice of the embodiments.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
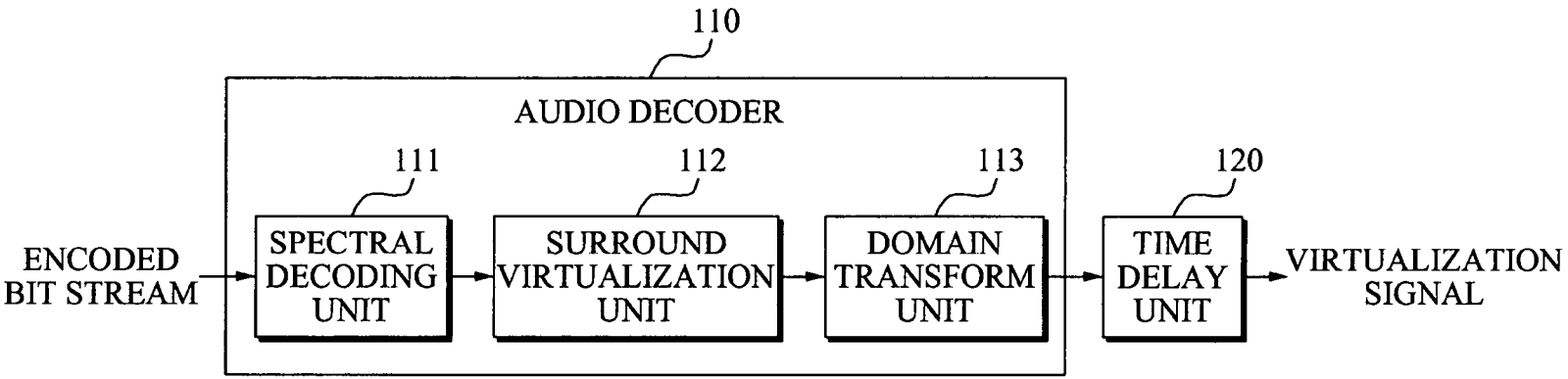
FIG. 1 illustrates a block diagram of a configuration of a surround sound virtualization apparatus according to example embodiments.

Reference will now be made in detail to example embodiments, examples of which are illustrated in the accompanying drawings, wherein like reference numerals refer to the like elements throughout. Example embodiments are described below to explain the present disclosure by referring to the figures.

FIG. 1 illustrates a block diagram of a configuration of a surround sound virtualization apparatus according to example embodiments.

Referring to FIG. 1, the surround sound virtualization apparatus may include an audio decoder 110 and a time delay unit 120. In this instance, the audio decoder 110 may perform head-related transfer function (HRTF) filtering. Also, the audio decoder 110 may include a spectral decoding unit 111, a surround virtualization unit 112, and a domain transform unit 113.

The spectral decoding unit 111 may extract a plurality of channel signals from an encoded bit stream. For example, the spectral decoding unit 111 may extract signals of a plurality of channels such as a front left channel, a front right channel, a center channel, a surround left channel, a surround right channel, and a low frequency effect (LFE) channel, from the encoded bit stream for 5.1 channel surround sound effect.

The surround virtualization unit 112 may perform the HRTF filtering with respect to the plurality of extracted channel signals. For example, when the plurality of extracted channel signals is a 5.1 channel signal, at least one response function may be multiplied with each of the plurality of extracted channel signals to perform the HRTF filtering. An interaural intensity difference (IID), spectral cues, etc., may be reflected in the plurality of channel signals through the HRTF filtering. Also, the HRTF filtering may be performed in a frequency domain.

The domain transform unit 113 may transform output signals of the surround virtualization unit 112 into a time domain. That is, the domain transform unit 113 may transform a frequency domain signal into a time domain signal, and output the transformed signal.

The time delay unit 120 may provide a time delay, that is, an interaural time difference (ITD), to the plurality of output signals of the audio decoder 110. That is, since the time delay may be provided outside of the audio decoder 110, computational costs for surround sound virtualization may be efficiently reduced.

As described above, the HRTF filtering may be performed in the audio decoder 110, the filtered signals may be transformed into the time domain again, and the time delay may be provided outside of the audio decoder 120. Accordingly, computational cost and complexity for surround sound virtualization may be reduced FIG. 2 is a diagram illustrating a configuration of a surround virtualization unit 200 according to example embodiments.

Figure 2:
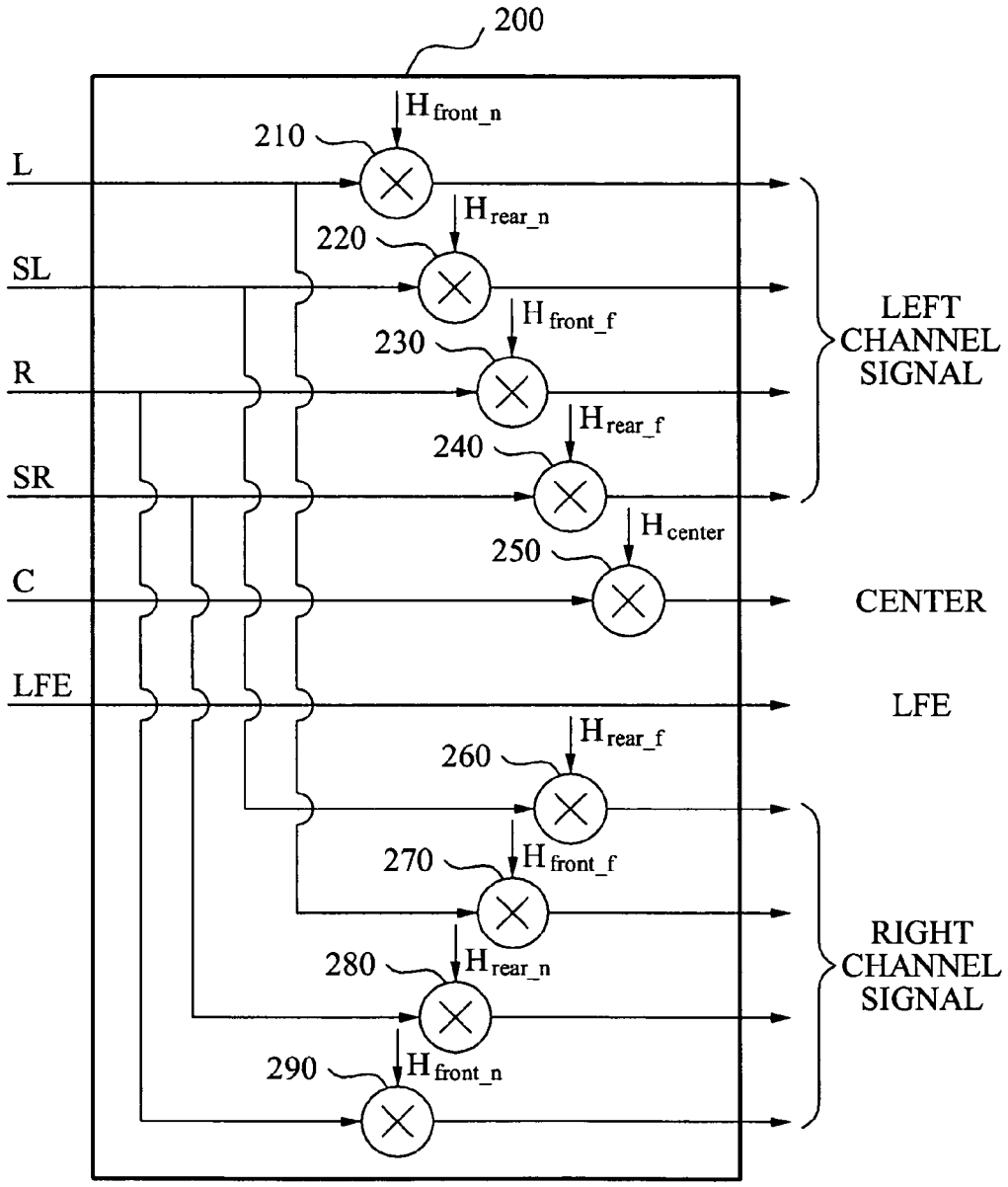
FIG. 2 illustrates a diagram of a configuration of a surround virtualization unit according to example embodiments.

Referring to FIG. 2, when 5.1 channel surround sound virtualization is performed, at least one multiplier 210, 220, 230, 240, 250, 260, 270, 280, and 290 may multiply a plurality of channel signals with at least one response function, $H_{front_n}$, $H_{rear_n}$, $H_{front_f}$, $H_{rear_f}$, and $H_{center}$. Here, the plurality of channels may indicate a front left channel, a front right channel, a center channel, a surround left channel, a surround right channel, and a Low Frequency Effects (LFE) channel. That is, the front left channel signal (L) may be multiplied with each of a first response function $H_{front_n}$ and a second response function $H_{front_f}$ through the first multiplier 210 and the second multiplier 270, and thereby may generate a first filter signal and a second filter signal. The surround left channel signal (SL) may be multiplied with each of a third response function $H_{rear_n}$ and a fourth response function $H_{rear_f}$ through the third multiplier 220 and the fourth multiplier 260, and thereby may generate a third filter signal and a fourth filter signal. The front right channel signal (R) may be multiplied with each of a fifth response function $H_{front_f}$ and a sixth response function $H_{front_n}$ through the fifth multiplier 230 and the sixth multiplier 290, and thereby may generate a fifth filter signal and a sixth filter signal. The surround right channel signal (SR) may be multiplied with each of a seventh response function $H_{rear_f}$ and an eighth response function $H_{rear_n}$ through the seventh multiplier 240 and the eighth multiplier 280 and thereby may generate a seventh filter signal and an eighth filter signal.

Here, the LFE channel signal may pass through a surround virtualization unit without being multiplied with a response function. The center channel signal (C) may be multiplied with a ninth response function $H_{center}$ through the ninth multiplier 250, and thereby may generate a ninth filter signal. Also, the first filter signal, the third filter signal, the fifth filter signal, and the seventh filter signal may be used for generation of left channel signals. The second filter signal, the fourth filter signal, the sixth filter signal, and the eighth filter signal may be used for generation of right channel signals. The ninth filter signal and the LFE channel signal may be used for the generation of both the left channel signals and the right channel signals.

Figure 3:
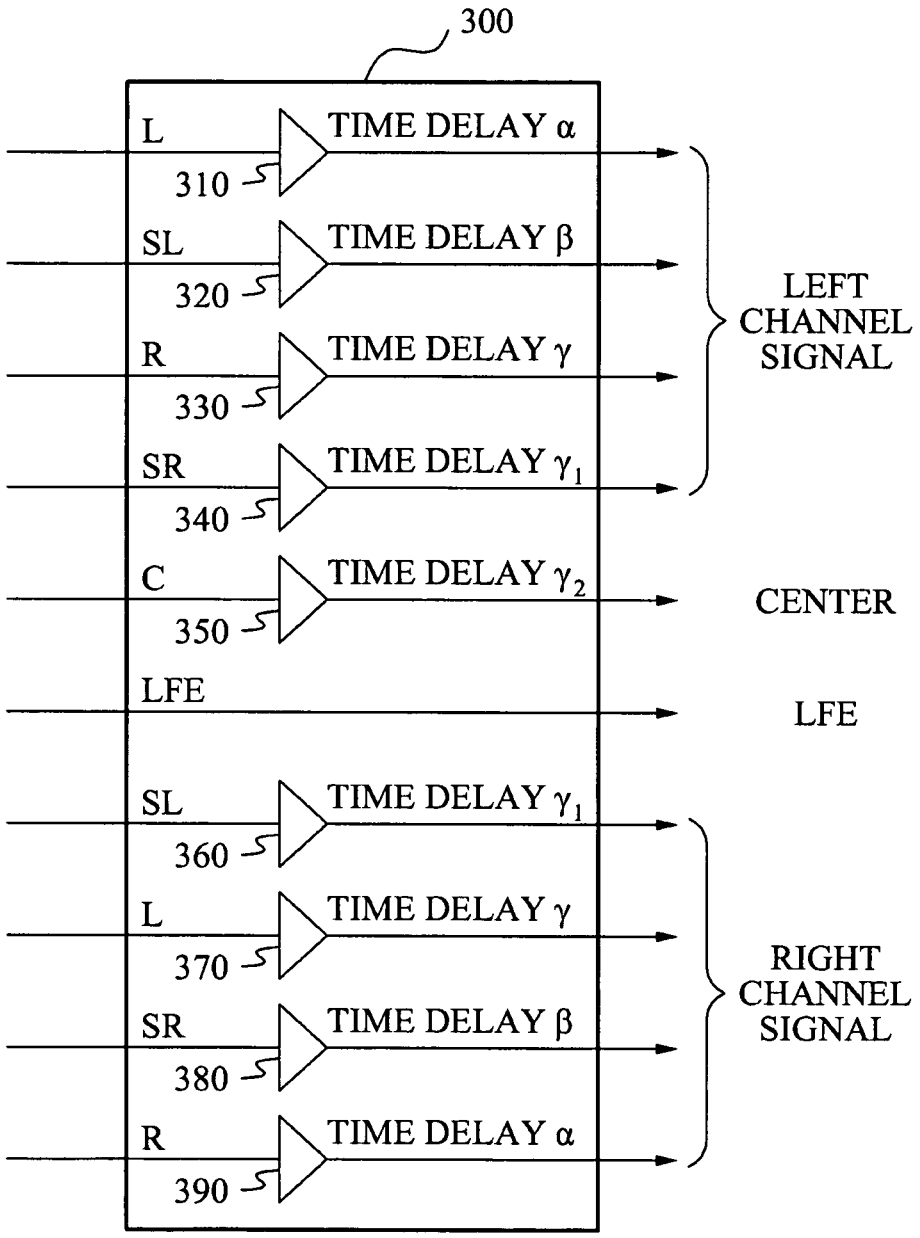
FIG. 3 illustrates a diagram of a configuration of a time delay unit according to example embodiments.

FIG. 3 is a diagram illustrating a configuration of a time delay unit 300 according to example embodiments.

Referring to FIG. 3, the time delay unit 300 may be located outside of an audio decoder, and may delay a plurality of channel signals, filtered in a surround virtualization unit, for a predetermined period of time. That is, the time delay unit 300 may provide a time delay to the plurality of filtered signals. For example, as illustrated in FIG. 2, when 5.1-channel surround sound is reproduced, the first filter signal, the third filter signal, the fifth filter signal, the seventh filter signal, the ninth filter signal, the second filter signal, the fourth filter signal, the sixth filter signal, and the eighth filter signal, filtered in the surround virtualization unit 200 of FIG. 2, may be delayed for the predetermined period of time through a first delay circuit 310, a second delay circuit 320, a third delay circuit 330, a fourth delay circuit 340, a fifth delay circuit 350, a sixth delay circuit 360, a seventh delay circuit 370, an eighth delay circuit 380, and a ninth delay circuit 390, respectively, of the time delay unit 300. Accordingly, a difference in arrival time of sound between left and right ears may be reflected and a realistic surround sound virtualization may be achieved.

Figure 4:
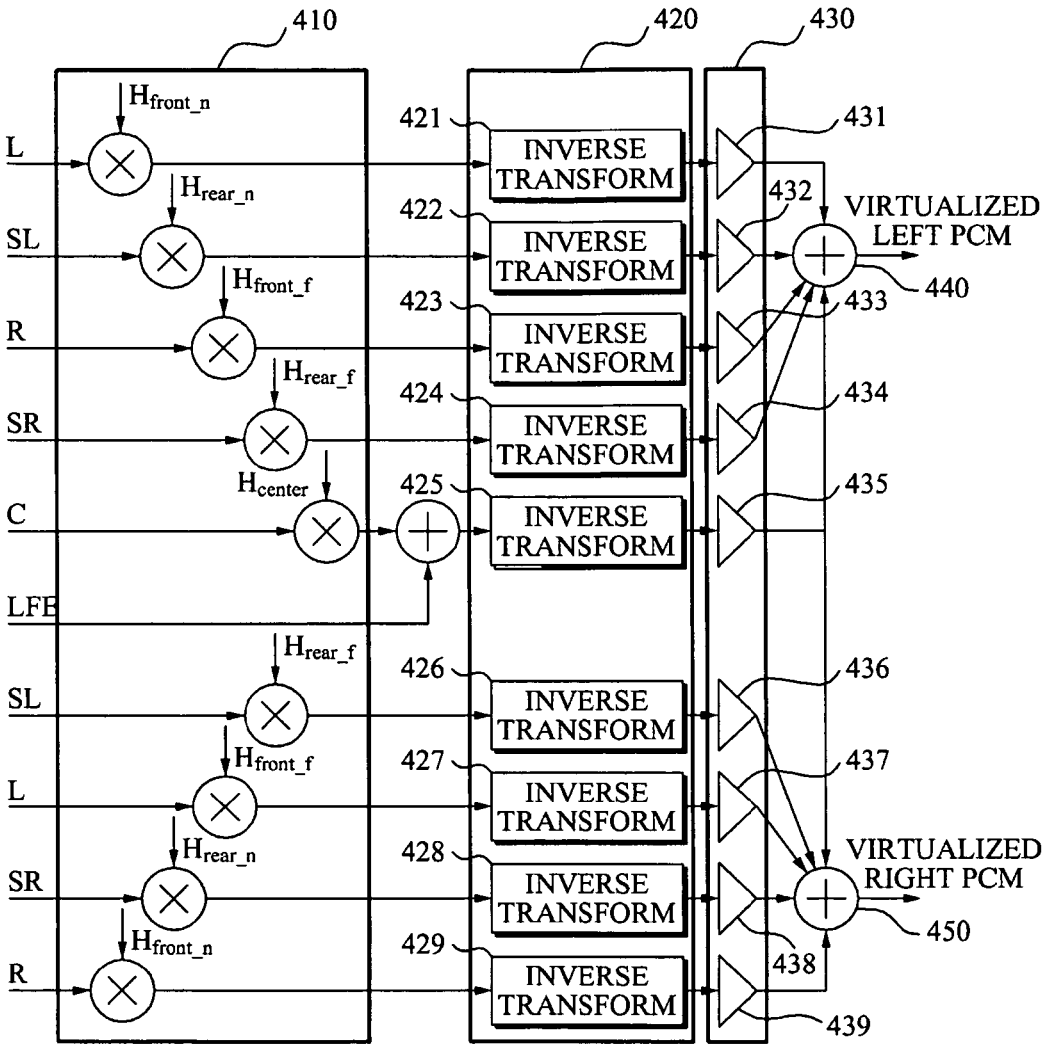
FIG. 4 illustrates a diagram of a detailed configuration of a surround sound virtualization apparatus according to example embodiments.

FIG. 4 illustrates a diagram of a detailed configuration of a surround sound virtualization apparatus according to example embodiments.

Referring to FIG. 4, when the surround sound virtualization apparatus virtualizes 5.1 channel surround sound, and a first filter signal, a second filter signal, a third filter signal, a fourth filter signal, a fifth filter signal, a sixth filter signal, a seventh filter signal, an eighth filter signal, a ninth filter signal, and an LFE channel signal may be filtered and/or outputted by a surround virtualization unit 410, a domain transform unit 420 may transform the nine outputted signals into a time domain. Here, the ninth filter signal (center channel signal from C) and the LFE channel signal from the LFE may be added by an adder, and inputted to the domain transform unit 420 as a single signal. Subsequently, a first inverse transform unit 421, a second inverse transform unit 422, a third inverse transform unit 423, a fourth inverse transform unit 424, a fifth inverse transform unit 425, a sixth inverse transform unit 426, a seventh inverse transform unit 427, an eighth inverse transform unit 428, and a ninth inverse transform unit 429, which are located in the domain transform unit 420, may transform a frequency domain of the nine inputted signals into the time domain. Also, the domain transform unit 420 may output the nine transformed signals. Also, the nine signals, transformed into the time domain through the nine inverse transform units 421, 422, 423, 424, 425, 426, 427, 428, and 429, may be delayed for a predetermined period of time through a first delay circuit 431, a second delay circuit 432, a third delay circuit 433, a fourth delay circuit 434, a fifth delay circuit 435, a sixth delay circuit 436, a seventh delay circuit 437, an eighth delay circuit 438, and a ninth delay circuit 439 of a time delay unit 430, and may be added and outputted by a first adder 440 as a virtualized left pulse-code modulation (PCM) and a second adder 450 as a virtualized right PCM.

Figure 5:
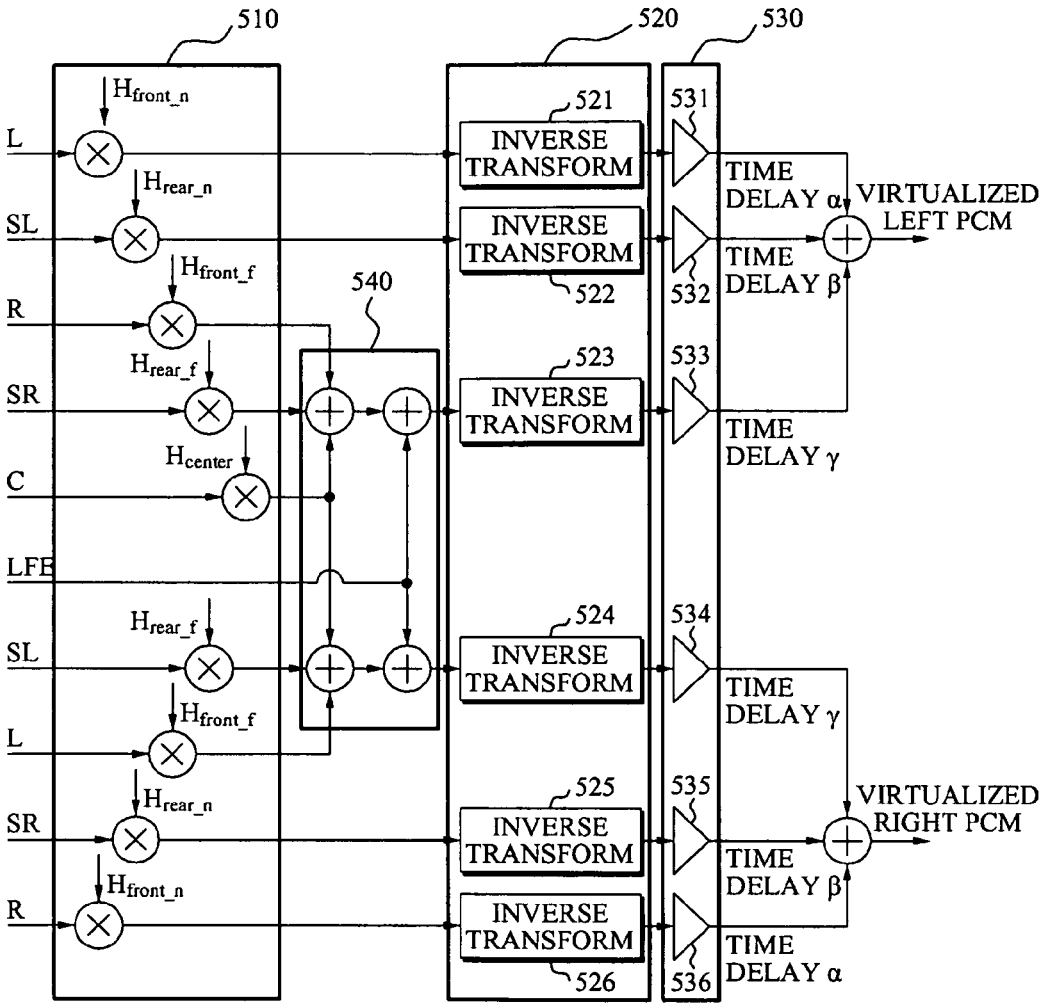
FIG. 5 illustrates a diagram of a detailed configuration of a surround sound virtualization apparatus according to other example embodiments.

FIG. 5 is a diagram illustrating a detailed configuration of a surround sound virtualization apparatus according to other example embodiments.

Referring to FIG. 5, when a first filter signal, a second filter signal, a third filter signal, a fourth filter signal, a fifth filter signal, a sixth filter signal, a seventh filter signal, an eighth filter signal, a ninth filter signal, and an LFE channel signal may be filtered and outputted by a surround virtualization unit 510, a portion of the ten outputted signals may be added and outputted by an adder 540. Specifically, the fifth filter signal, the seventh filter signal, and the ninth filter signal may be added as a single signal. The added signal and the LFE channel signal may be added and outputted. Also, the second filter signal, the fourth filter signal, and the ninth filter signal may be added as a single signal. The added signal and the LFE channel signal may be added and outputted. Accordingly, six filter signals including the two signals, added and outputted by the adder 540, may be inputted to a domain transform unit 520.

The six inputted signals may be transformed into a time domain through the domain transform unit 520. Specifically, a first inverse transform unit 521, a second inverse transform unit 522, a third inverse transform unit 523, a fourth inverse transform unit 524, a fifth inverse transform unit 525, and a sixth inverse transform unit 526, which located in the domain transform unit 520, may transform a frequency domain of the six inputted signals into the time domain, and the domain transform unit 520 may output the six transformed signals. Also, the six signals, transformed into the time domain through the six inverse transform unit 521, 522, 523, 524, 525, and 526 may be delayed for a predetermined period of time through a first delay circuit 531, a second delay circuit 532, a third delay circuit 533, a fourth delay circuit 534, a fifth delay circuit 535, and a sixth delay circuit 536 all of a time delay unit 530, and may be added by two adders and outputted as two signals, a virtualized left PCM and a virtualized right PCM.

Figure 6:
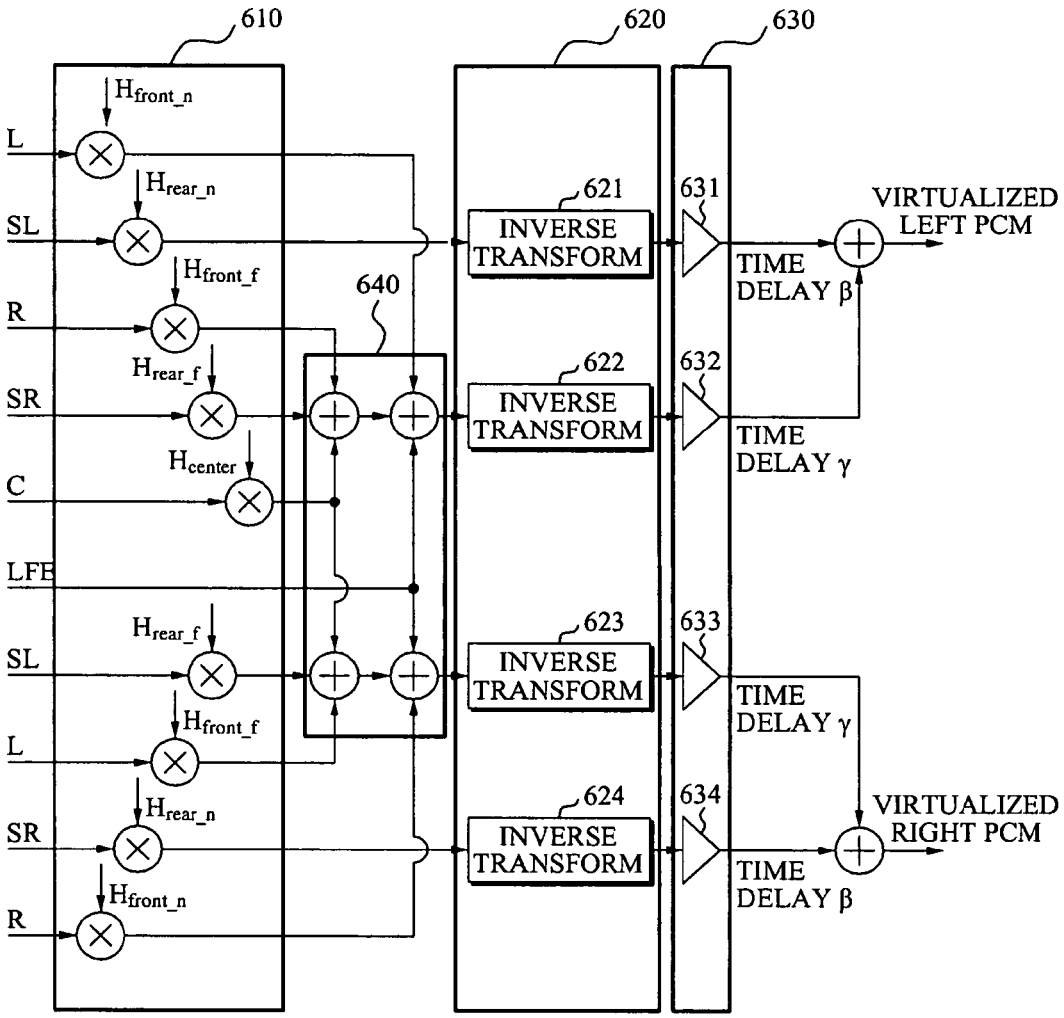
FIG. 6 illustrates a diagram of a detailed configuration of a surround sound virtualization apparatus according to still other example embodiments.

FIG. 6 is a diagram illustrating a detailed configuration of a surround sound virtualization apparatus according to still other example embodiments.

Referring to FIG. 6, when a first filter signal, a second filter signal, a third filter signal, a fourth filter signal, a fifth filter signal, a sixth filter signal, a seventh filter signal, an eighth filter signal, a ninth filter signal, and an LFE channel signal may be filtered and/or outputted by a surround virtualization unit 610, a portion of the ten outputted signals may be added and outputted by an adder 640. Specifically, the fifth filter signal, the seventh filter signal, and the ninth filter signal may be added as a single signal. The added single signal, the LFE channel signal, and the first filter signal may be added and outputted. Also, the second filter signal, the fourth filter signal, and the ninth filter signal may be added as another single signal. Here, the other added single signal, the LFE channel signal, and the sixth filter signal may be added and outputted. That is, four filter signals including the two signals, added and outputted by the adder 640, may be inputted to a domain transform unit 620.

The four inputted signals may be transformed into a time domain through the domain transform unit 620. Specifically, a first inverse transform unit 621, a second inverse transform unit 622, a third inverse transform unit 623, and a fourth inverse transform unit 624, which are all located in the domain transform unit 620, may transform a frequency domain of the four inputted signals into the time domain, and the domain transform unit 620 may output the four transformed signals. Also, the four signals, transformed into the time domain through the four inverse transform units 621, 622, 623, and 624 may be delayed for a predetermined amount of time through a first delay circuit 631, a second delay circuit 632, a third delay circuit 633, and a fourth delay circuit 634, all of a time delay unit 630, and may be added by two adders and outputted as two signals, a virtualized left PCM and a virtualized right PCM.

Figure 7:
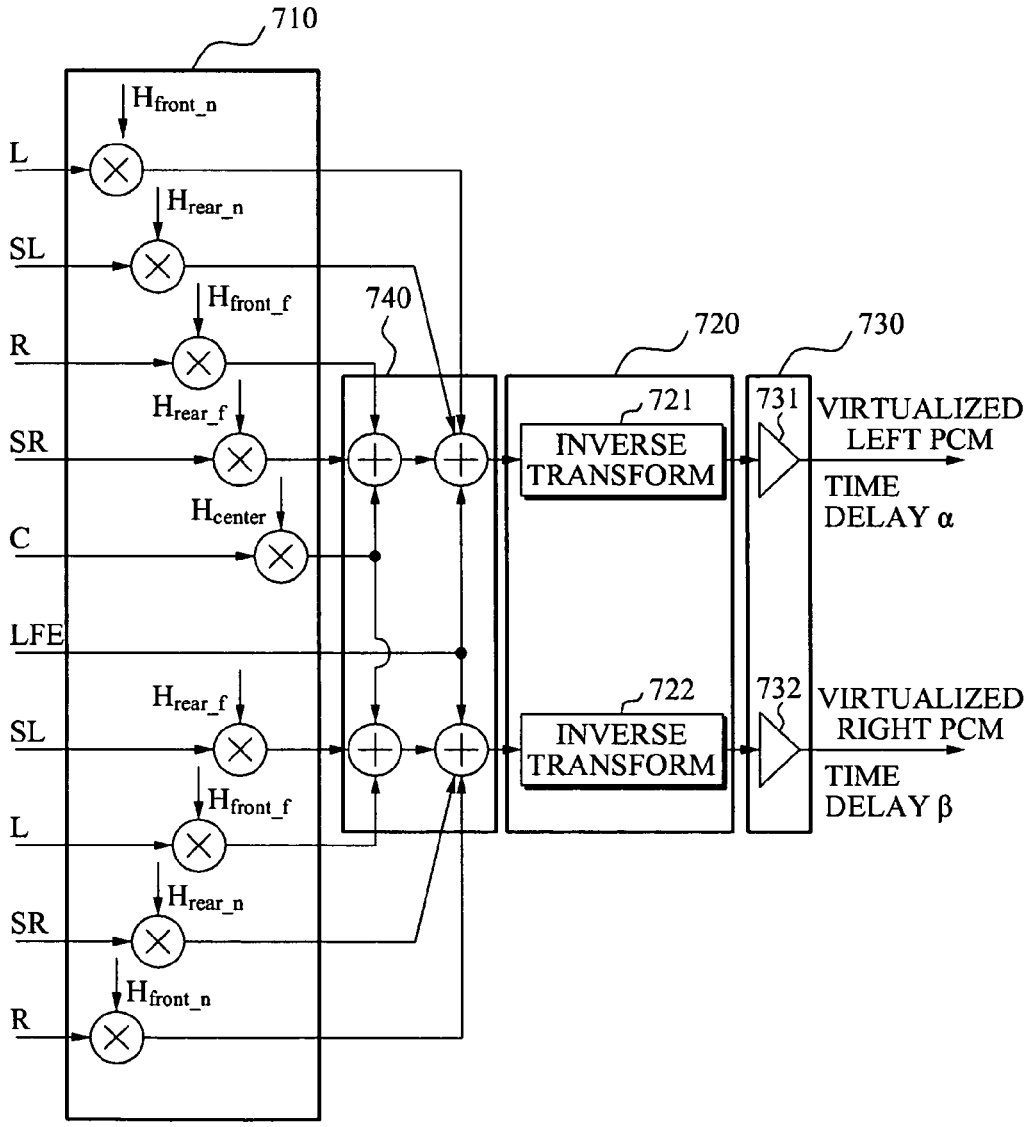
FIG. 7 illustrates a diagram of a detailed configuration of a surround sound virtualization apparatus according to yet other example embodiments.

FIG. 7 is a diagram illustrating a detailed configuration of a surround sound virtualization apparatus according to yet other example embodiments.

Referring to FIG. 7, when a first filter signal, a second filter signal, a third filter signal, a fourth filter signal, a fifth filter signal, a sixth filter signal, a seventh filter signal, an eighth filter signal, a ninth filter signal, and an LFE channel signal may be filtered and outputted by a surround virtualization unit 710, a portion of the ten outputted signals may be added and outputted by an adder 740. Specifically, the fifth filter signal, the seventh filter signal, and the ninth filter signal may be added as a single signal. The added single signal, the LFE channel signal, the first filter signal, and the third filter signal may be added and outputted. Also, the second filter signal, the fourth filter signal, and the ninth filter signal may be added as another single signal. Here, the other added signal, the LFE channel signal, the sixth filter signal, and the eighth filter signal may be added and outputted. That is, two filter signals, added and outputted by the adder 740, may be inputted to a domain transform unit 720.

The two inputted signals may be transformed into a time domain through the domain transform unit 720. Specifically, a first inverse transform unit 721 and a second inverse transform unit 722, which are located in the domain transform unit 720, may transform a frequency domain of the two inputted signals into the time domain, and the domain transform unit 720 may output the two transformed signals. Also, the two signals, transformed into the time domain through the two inverse transform units 721 and 722 may be delayed for a predetermined period of time through a first delay circuit 731 and a second delay circuit 732, all of a time delay unit 730, and may be outputted as two signals, a virtualized left PCM and a virtualized right PCM.

As described above, signals having a similar time delay interval from among output signals of a surround virtualization unit may be added, transformed, and delayed. Accordingly, the surround sound virtualization apparatus may reduce computational costs.

Figure 8:
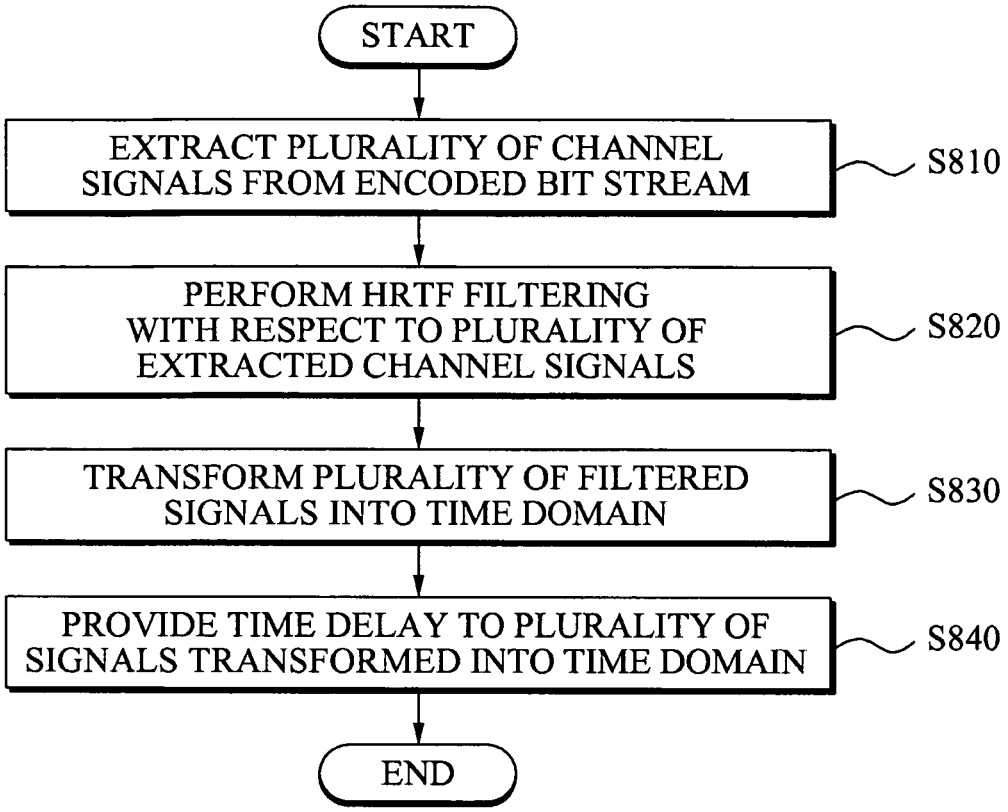
FIG. 8 illustrates a flowchart of a surround sound virtualization method according to example embodiments.

FIG. 8 illustrates a flowchart of a surround sound virtualization method according to example embodiments.

Referring to FIG. 8, in operation S810, a plurality of channel signals may be extracted from an encoded bit stream. Accordingly, when a 5.1 channel sound is reproduced, the encoded bit stream may be decompressed, and six signals may be generated.

In operation S820, HRTF filtering may be performed with respect to the plurality of extracted channel signals. Here, an IID, spectral cues, etc. may be applied to the plurality of channel signals through the HRTF filtering.

In operation S830, the plurality of filtered signals may be transformed into a time domain. That is, since the HRTF may be performed in a frequency domain, the frequency domain signal may be transformed into the time domain signal.

In operation S840, a time delay may be provided to the plurality of signals transformed into the time domain. Accordingly, a predetermined time delay value may be applied to the plurality of signals transformed into the time domain, and thus an ITD between left and right ears may be reflected.

As described above, the HRTF filtering may be performed inside an audio decoder and a time delay may be provided outside of the audio decoder. Accordingly, computational costs and complexity for surround sound virtualization may be reduced, and an efficiency of a surround sound virtualization apparatus may be improved.

In addition to the above described embodiments, embodiments can also be implemented through computer readable code/instructions in/on a medium, e.g., a computer readable medium, to control at least one processing device to implement any above described embodiment. The medium can correspond to any medium/media permitting the storing and/or transmission of the computer readable code.

The computer readable code can be recorded on a medium in a variety of ways, with examples of recording media including magnetic storage media (e.g., ROM, floppy disks, hard disks, etc.) and optical recording media (e.g., CD-ROMs, or DVDS). The computer readable code may also be transferred through transmission media as well as elements of the Internet, for example. Thus, the medium may be such a defined and measurable structure carrying or controlling a signal or information, such as a device carrying a bitstream, for example, according to one or more embodiments. The media may also be a distributed network, so that the computer readable code is stored/transferred and executed in a distributed fashion. Still further, as only an example, the processing device could include a processor or a computer processor, and processing elements may be distributed and/or included in a single device.

Although a few example embodiments have been shown and described, it would be appreciated by those skilled in the art that changes may be made in these example embodiments without departing from the principles and spirit of the disclosure, the scope of which is defined in the claims and their equivalents.

What is claimed is:

1. A surround sound virtualization apparatus, comprising:
an audio decoder, wherein the audio decoder comprises:
a surround virtualization unit to perform head-related transfer function (HRTF) filtering to a plurality of channel signals, and
a domain transform unit to transform a plurality of output signals of the surround virtualization unit into a time domain; and
a time delay unit to provide time delays on a per signal basis to a plurality of output signals transformed by the domain transform unit,
wherein the domain transform unit comprises:
a signal addition unit to add a proper subset of output signals of the surround virtualization unit into at least one added output signal; and
an inverse transform unit to transform the at least one added output signal into the time domain,
wherein a plurality of signals input to the inverse transform unit is less than the plurality of channel signals output from the surround virtualization unit,
the HRTF filtering is performed inside the audio decoder and the time delay unit provides the time delay outside of the audio decoder, and
the time delays are related to an interaural time difference.

2. The surround sound virtualization apparatus of claim 1, wherein the audio decoder further comprises:
a spectral decoding unit to extract a plurality of channel signals from an encoded bit stream,
and the surround virtualization unit performs the HRTF filtering with respect to the plurality of extracted channel signals.

3. The surround sound virtualization apparatus of claim 1, wherein the surround virtualization unit performs the HRTF filtering in a frequency domain.

4. The surround sound virtualization apparatus of claim 1, wherein the surround virtualization unit multiplies the plurality of extracted channel signals with a plurality of response functions for applying an HRTF frequency characteristic.

5. The surround sound virtualization apparatus of claim 1, wherein, when a 5.1 channel sound is reproduced, the surround virtualization unit
multiplies a front left channel signal with each of a first response function and a second response function to generate a first filter signal and a second filter signal,
multiplies a surround left channel signal with each of a third response function and a fourth response function to generate a third filter signal and a fourth filter signal,
multiplies a front right channel signal with each of a fifth response function and a sixth response function to generate a fifth filter signal and a sixth filter signal,
multiplies a surround right channel signal with each of a seventh response function and an eighth response function to generate a seventh filter signal and an eighth filter signal,
multiplies a center channel signal with a ninth response function to generate a ninth filter signal, and
outputs the first filter signal, the second filter signal, the third filter signal, the fourth filter signal, the fifth filter signal, the sixth filter signal, the seventh filter signal, the eighth filter signal, the ninth filter signal, and a low frequency effect (LFE) channel signal.

6. The surround sound virtualization apparatus of claim 5, wherein the domain transform unit transforms at least one of the first filter signal, the second filter signal, the third filter signal, the fourth filter signal, the fifth filter signal, the sixth filter signal, the seventh filter signal, the eighth filter signal, the ninth filter signal, and the LFE channel signal into the time domain.

7. The surround sound virtualization apparatus of claim 6, wherein the time delay unit delays at least one of the first filter signal, the second filter signal, the third filter signal, the fourth filter signal, the fifth filter signal, the sixth filter signal, the seventh filter signal, the eighth filter signal, the ninth filter signal, and the LFE channel signal, transformed into the time domain, for a predetermined period of time, and outputs respective delayed signals.

8. The surround sound virtualization apparatus of claim 1, wherein the signal addition unit adds all or a portion of the output signals of the surround virtualization unit into at least one added output signal.

9. The surround sound virtualization apparatus of claim 1, further comprising:
a first adder to add a first group of at least three transformed output signals provided the time delay by the time delay unit; and
a second adder to add a second group of at least three transformed output signals provided the time delay by the time delay unit.

10. A surround sound virtualization method, comprising:
extracting a plurality of channel signals from an encoded bit stream;
performing head-related transfer function (HRTF) filtering with respect to the plurality of extracted channel signals;
transforming a plurality of the filtered extracted channel signals into a time domain; and
providing time delays on a per signal basis to a plurality of signals transformed into the time domain,
wherein the transforming comprises:
adding a proper subset of the filtered extracted channel signals into at least one added output signal; and
transforming the at least one added output signal into the time domain,
wherein the number of signals transformed into the time domain is less than the number of filtered extracted channel signals, the extracting, performing, and transforming are performed within an audio decoder, and the providing the time delay is provided by a time delay unit disposed outside of the audio decoder, and the time delays are related to an interaural time difference.

11. The surround sound virtualization method of claim 10, wherein the performing of the HRTF filtering performs the HRTF filtering in a frequency domain.

12. The surround sound virtualization method of claim 10, wherein the performing of the HRTF filtering multiplies the plurality of extracted channel signals with a plurality of response functions for applying an HRTF frequency characteristic.

13. The surround sound virtualization method of claim 12, wherein, when a 5.1 channel sound is reproduced, the performing of the HRTF filtering comprises:

multiplying a front left channel signal with each of a first response function and a second response function and generating a first filter signal and a second filter signal, multiplying a surround left channel signal with each of a third response function and a fourth response function and generating a third filter signal and a fourth filter signal, multiplying a front right channel signal with each of a fifth response function and a sixth response function and generating a fifth filter signal and a sixth filter signal, multiplying a surround right channel signal with each of a seventh response function and an eighth response function and generating a seventh filter signal and an eighth filter signal, multiplying a center channel signal with a ninth response function and generating a ninth filter signal; and outputting the first filter signal, the second filter signal, the third filter signal, the fourth filter signal, the fifth filter signal, the sixth filter signal, the seventh filter signal, the eighth filter signal, the ninth filter signal, and a low frequency effect (LFE) channel signal.

14. The surround sound virtualization method of claim 13, wherein the transforming transforms at least one of the first filter signal, the second filter signal, the third filter signal, the fourth filter signal, the fifth filter signal, the sixth filter signal, the seventh filter signal, the eighth filter signal, the ninth filter signal, and the LFE channel signal into the time domain.

15. The surround sound virtualization method of claim 10, wherein the adding comprises adding all or a portion of the plurality of filtered signals into at least one added signal.

16. The surround sound virtualization method of claim 10, further comprising:

adding a first group of transformed output signals from among the plurality of signals after providing the time delay; and adding a second group of transformed output signals from among the plurality of signals after providing the time delay.

17. A non-transitory computer-readable recording medium storing a program for causing a computer to implement a surround sound virtualization method, comprising:

extracting a plurality of channel signals from an encoded bit stream;

performing head-related transfer function (HRTF) filtering with respect to the plurality of extracted channel signals;

transforming a plurality of the filtered extracted channel signals into a time domain; and providing time delays on a per signal basis to a plurality of signals transformed into the time domain, wherein the transforming comprises:

adding a proper subset of the filtered extracted channel signals into at least one added output signal; and transforming the at least one added output signal into the time domain, wherein the number of signals transformed into the time domain is less than the number of filtered extracted channel signals, the extracting, performing, and transforming are performed within an audio decoder, and the providing the time delay is provided by a time delay unit disposed outside of the audio decoder, and the time delays are related to an interaural time difference.

* * * * *